United States Patent [19]

Hamilton

[11] Patent Number: 4,977,672

[45] Date of Patent: Dec. 18, 1990

[54] HAIR-SCULPTURING STRUCTURE AND METHOD

[76] Inventor: Paul M. Hamilton, 15 Oak Ave., West Newton, Mass. 02165

[21] Appl. No.: 350,157

[22] Filed: May 11, 1989

[51] Int. Cl.[5] ..... B26B 19/00; B26B 13/00; A45D 24/36

[52] U.S. Cl. ..... 30/233; 30/200; 132/214

[58] Field of Search ..... 30/200, 233; 132/65.1, 132/21.2, 213, 214

[56] References Cited

U.S. PATENT DOCUMENTS

| | | | |
|---|---|---|---|
| 2,550,972 | 5/1951 | Cohen | 132/214 |
| 3,055,379 | 9/1962 | Walls | 30/200 |
| 3,651,540 | 3/1972 | Groves | 30/233 |
| 3,972,075 | 8/1976 | Alevras | 132/214 |
| 4,131,995 | 1/1979 | Pires | 30/200 |

*Primary Examiner*—Douglas D. Watts
*Assistant Examiner*—Paul M. Heyrana, Sr.
*Attorney, Agent, or Firm*—William Nitkin

[57] ABSTRACT

A template for cutting designs in hair comprising a flexible planar member having a front and back with an aperture defined therein in the desired shape of the design to be cut in the hair with the inner edges of the aperture beveled inwardly from the front to the back, the template adapted to be placed upon the head and bent to the head's curvature with the hair that falls within the aperture of the template to be removed.

3 Claims, 1 Drawing Sheet

HAIR-SCULPTURING STRUCTURE AND METHOD

BACKGROUND OF THE INVENTION

1. Field of the Invention

The device of this invention resides in the area of hair styling and more particularly relates to a structure and method for sculpturing hair to various shapes.

2. Description of the Prior Art

Hairstyling is extremely important to an individual's appearance and the adoption of stylish haircuts is very desirable. One such style incorporates the placement of designs on the head by removal of hair in that particular design thereby allowing the scalp to show through.

SUMMARY OF THE INVENTION

It is an object of this invention to provide an improved structure and method for the cutting of designs within hair so that a plurality of designs can be easily and efficiently cut in the hair thereby allowing the scalp to show through which result is desirable for many people who wish particular design to appear in their hair style.

The invention includes a specially designed template having an aperture formed therein in the shape of the design to be cut in the hair. It has been found that certain design parameters are necessary for the most successfull use of such a template used in conjuction with hair clippers.

DESCRIPTION OF THE PREFERRED EMBODIMENT(S)

Figure 1:
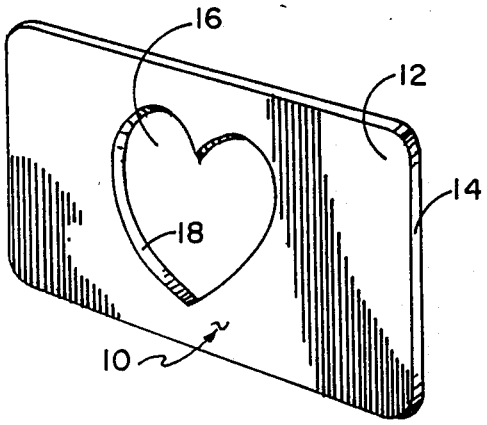
FIG. 1 illustrates a perspective view of a template of this invention.
Figure 2:
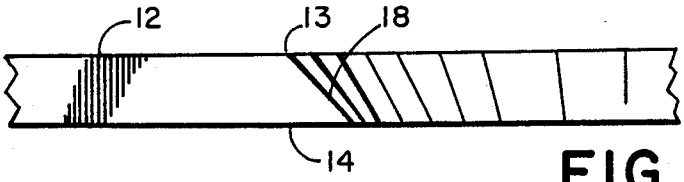
FIG. 2 illustrates a sectional view from the side of a portion of the edge of the aperture formed in the template of this invention.

FIG. 1 illustrates template 10 of this invention having front 12 and back 14. The template is approximately 1/16 inch thick and can be made of a plastic material that is flexible so that it can be bent to the curvature of the head on which it is to be utilized. Aperture 16 can be in any desired shape such as a heart, star, or any other design. The inside edges of aperture 16 must be beveled at an acute angle from the top to the back as seen in FIG. 2 where, from outer edge 13 the beveled edge 18 extends inwardly toward the back 14 of the template. It has been found that hairclippers cannot properly cut to the edges of a templete which does not have such a beleved edge.

Figure 3:
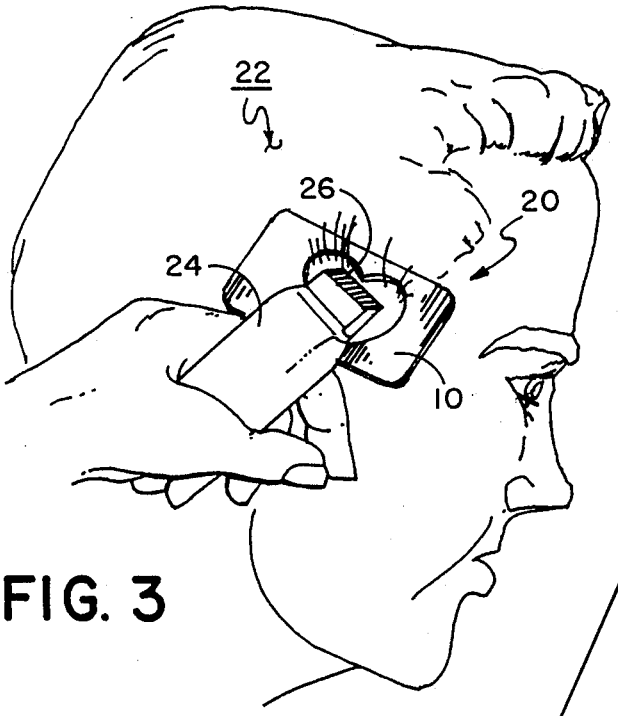
FIG. 3 illustrates a perspective view of a template of this invention in position on a person's head with hairclippers removing hair from whithin the template's aperture.

FIG. 3 illustrates template 10 being applied to an individual whose hair 20 is being cut. The template is seen bent around curvature 22 of the head and hairclippers 24 are manually used with cutter 26 thereon. Cutter 26 is of a small variety wellknown in the trade and can be utilized to shave the hair away from within the template aperture area 16 so as to leave a space within the template without hair which can be left to show the scalp or colored as desired by the wearer of the hairstyle. In some embodiments, coloring may be applied to the hair or to the scalp through aperture 16, forming a colored area on the head in the shape of the aperture.

Figure 4:
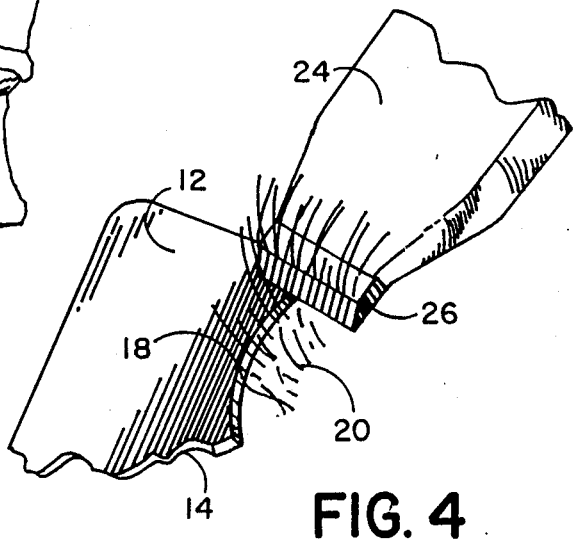
FIG. 4 illustrates a closeup perspective view of the hairclippers removing hair along the edge of the aperture in the template.

FIG. 4 illustrates the usage of hairclippers 24 with small cutter 26 clipping against beleved edge 18 and removing hair 20 along the template where front 12 of template 10 is seen and back 14 is placed against the scalp. By having a beleved edge on template 10, one can maneuver hairclippers 24 in such a way as to come right to the edge of the template for successful and accurate cutting of the design within the hair. By using the template of this invention with the beveled edge, one incorporates better definition in the design cut in the hair and allows the blade of cutter 26 to be used first directly against the head within the aperture. By riding the blade against the beleved edge of the template, one can very accurately cut designs in the hair as desired by the user.

Although the present invention has been described with reference to particular embodiments, it will be apparent to those skilled in the art that variations and modifications can be substituted therefor without departing from the principles and spirit of the invention.

I claim:

1. A template for cutting designs in hair on a person's head, comprising:

a flexible planar member having a front and back with an aperture defined therein in the desired shape of the design to be cut in the hair, said aperture surrounded by said planar member on all sides with the inner edges of said aperture beveled inwardly from the front to the the back, said template positioned upon the head and bent to the head's curvature with the hair that falls within the aperture in said template to be removed to the scalp by cutting.

2. A method of cutting designs in hair on a person's head comprising the steps of:

placing a thin, planar flexible template having an aperture defined therein in the shape desired to be cut in the hair on the head where said design is to be cut;

providing an inner-angled bevel on the inside edges of said aperture of said template; and cutting along said bevel to remove hair close to the edge of said aperture and within said aperture so as to remove the hair to the scalp with sharp definition from the remaining hair on the head.

3. A template for cutting designs in hair on a person's head, comprising:

a flexible planar member having a front and back with an aperture defined therein in the desired shape of the design to be cut in the hair, said aperture surrounded by said planar member on all sides, said template positioned upon the head and bent to the head's curvature with the hair that falls within the aperture in said template to be removed by cutting.

* * * * *